United States Patent [19]

Halinen et al.

[11] Patent Number: 4,775,463

[45] Date of Patent: Oct. 4, 1988

[54] PROCESS FOR THE FLOTATION OF PHOSPHATE MINERAL AND AN AGENT TO BE USED IN THE FLOTATION

[75] Inventors: Aija- R. Halinen, Espoo; Anders Weckman, Helsinki, both of Finland

[73] Assignee: Kemira Oy, Helsinki, Finland

[21] Appl. No.: 31,567

[22] Filed: Mar. 30, 1987

[30] Foreign Application Priority Data

Apr. 1, 1986 [FI] Finland ..... 861415

[51] Int. Cl.[4] ..... B03D 1/02

[52] U.S. Cl. ..... 209/166; 252/61

[58] Field of Search ..... 209/166, 167, 902; 252/61

[56] References Cited

U.S. PATENT DOCUMENTS

| | | | |
|---|---|---|---|
| T106,002 | 11/1985 | Mair et al. | 209/166 |
| 2,014,717 | 9/1935 | Burdick | 209/166 |
| 2,162,494 | 6/1939 | Trotter | 209/166 |
| 4,274,950 | 6/1981 | Larribau | 209/166 |
| 4,295,962 | 10/1981 | Parlman | 209/166 |
| 4,526,696 | 7/1985 | Delouran | 209/166 |
| 4,588,498 | 5/1986 | Mair et al. | 209/166 |
| 4,600,505 | 7/1986 | Mair et al. | 209/166 |

FOREIGN PATENT DOCUMENTS

| | | | |
|---|---|---|---|
| 860866 | 9/1981 | U.S.S.R. | 209/166 |

*Primary Examiner*—Kenneth M. Schor
*Assistant Examiner*—Thomas M. Lithgow
*Attorney, Agent, or Firm*—Banner, Birch, McKie and Beckett

[57] ABSTRACT

The invention relates to a method of separating phosphatic minerals from phosphate ores, especially from phosphate carbonate ores by flotation in the presence of a collector, which comprises a compound having the general formula $$X_1-(CH_2)_l-Y-(CH_2)_m-X_2 \qquad \text{I}$$

or its salt, in which formula l and m are mutually independently 0 or 1,

Y is —S—, —SO— or —OSO—, $X_1$ and $X_2$ are mutually independently —R or —CR(R'$Z_1$)$Z_2$, $Z_1$ and $Z_2$ are mutually independently —H, —OR, —COOR, —OCOR, —NR'COR, —CONR'R, —COSR, —CSOR, —COR or —$SO_3H$ or $Z_1$ and $Z_2$ form together with the carbon atoms to which they are bound the group

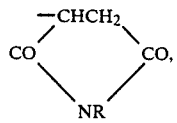

R and R' are mutually independently H or a hydrocarbon containing 1–30 carbon atoms, which may be straight chained or branched, saturated or unsaturated, aliphatic or aromatic, containing possibly one or several groups among —O—, —NH—, —OCO—, —COO—, —NR'CO—, —CONR'—, —CO—, provided however that the compound according to formula I contains at least one group among —COOH, —$SO_3H$,

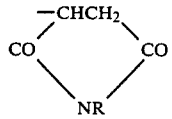

The invention also relates to an agent to be used in the flotation.

8 Claims, No Drawings

PROCESS FOR THE FLOTATION OF PHOSPHATE MINERAL AND AN AGENT TO BE USED IN THE FLOTATION

This invention relates to a process of separating phosphate minerals from phosphate ore, in particular from phosphate carbonate ore, by flotation in the presence of a collector, and to the agent to be used in the flotation.

The phosphate ores get continuously poorer and harder to dress. The major part of the world's phosphate resources are of a sedimental origin which is hard to dress, having thus to be particularly finely ground because of the structure of the ore. The selectivity and performance of chemicals in fine grain catagories are then accentuated. Although there has been an evolution in this sector, the separation of various calcium minerals from finely ground ore still constitutes a problem. Traditionally, the problem of treating finely divided substances has been solved by the so-called slime separation, whereby part of the apatite disappears in the residue. As a consequence, they yield is low.

The FI patent specification No. 64 755 discloses a manner of concentrating phosphate-containing minerals from carbonate and silicate-containing systems by first carrying out a flotation at a pH value above 6 with a collector agent of amidocarboxylic acid type in the presence of a depressing agent and by subsequently subjecting the obtained froth product to a selective secondary flotation at a pH value of 4–5,5. The collector agent applied may have the general formula

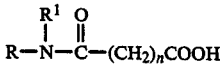

in which R is a saturated or unsaturated aliphatic group containing 7–30 carbon atoms, $R^1$ is hydrogen or an alkyl group containing 1–4 carbon atoms and n is 1–8.

Collectors containing sulphur are extremely common when concentrating sulphide ores. Xanthates, mercaptobenzothiazoles, dithiocarbamates, thiocarbamates and dithiophosphates are generally used.

In the case of non-sulphidous ores, like phosphate ore, the sulphurous collectors have mostly been the derivates of sulphosuccinic acid (U.S. Pat. No. 4,158,623, SU-1 113 174).

The most generally used collector agents at present are probably the fatty acids. The fatty acids may be unsaturated or for instance technical fatty acid mixtures. The suggested collector agents also include other agents, like alkyl benzene sulphonate, alkyle sulphonate and amines.

In order to improve the selectivity of the separation of phosphate and carbonate minerals and to increase the yield, various regulating chemicals ae often used in the flotation. By means of additives the total consumption of chemicals and/or costs may be reduced. The generally known regulating chemicals comprise among others water-glass, corn starch, gum arabic, CMC, mineral, oil, carbon or sulphur dioxide gas and various emulsifiers and frothers. The prior known processes and chemicals have the disadvantage of giving a phosphate concentrate of poor quality when one tries to obtain a high recovery, especially when carbonate minerals are flotated along with the phosphates.

The purpose of this invention is to provide a process, by means of which phosphate minerals, like apatite, may be efficiently and selectively separated from other minerals. According to the invention specific sulphur compounds prior unknown for this purpose are used as collector agents in the flotation, these compounds improving the recovery and the selectivity in particular in respect of the carbonate minerals. The invention is characterized in that the flotation is carried out in the presence of a collector, which comprises a compound of the general formula

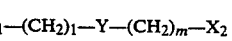

I or its salt, in which formula l and m are mutually independently 0 or 1,

Y is —S—, —SO— or —OSO—, $X_1$ and $X_2$ are mutually independently —R or —CR(R'$Z_1$)$Z_2$, $Z_1$ and $Z_2$ are mutually independently —H, —OR, —COOR, —OCOR, —NR'COR, —CONR'R, —COSR, —CSOR, —COR or —$SO_3H$ or $Z_1$ and $Z_2$ form together with the carbon atoms to which they are bound the group

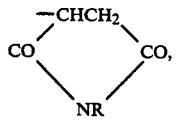

R and R' are mutually independently H or a hydrocarbon containing 1–30 carbon atoms, which may be straight chained or branched, saturated or unsaturated, aliphatic or aromatic, possibly containing one or several groups among —O—, —NH—, —OCO—, —COO—, —NR'CO—, —CONR—, —CO—, provided however that the compound according to formula I contains at least one group among —COOH, —$SO_3H$

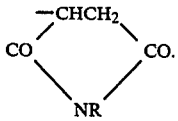

Preferable salts of the compounds according to formula I are alkali metal salts and ammonium salts.

Particularly advantageous sub-classes of the compounds according to formula I are formed by the compounds having the general formulas

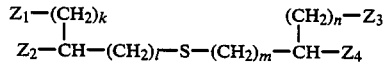

II

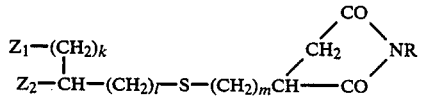

IV

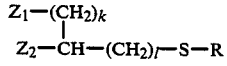

VI or their salts, in which formulas k, l, m, and n are mutually independently 0 or 1, $Z_1$, $Z_2$, $Z_3$ and $Z_4$ are mutually independently —H, —OH, —COOH, —OCOR, —COOR, —NR'COR, —CONR'R, —COSR, —CSOR, —COR or —$SO_3H$ and R and R' are mutually independently a hydrocarbon containing 1–30 carbon atoms, which may be straight chained or branched, saturated or unsaturated, aliphatic or aromatic, containing possibly one or several groups among —O—, —NH—, —OCO—, —COO—, —NR'CO—, —CONR', —CO—, provided however that the compounds according to formulas II, IV and VI contain at least one group among —COOH, —$SO_3H$,

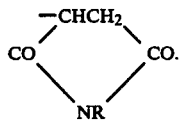

The compounds according to formula I having the following general formula are particularly advantageous

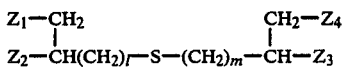

III

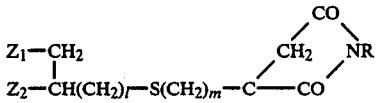

V

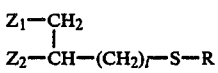

VII or their salts, in which formulas l and m are mutually independently 0 or 1, $Z_1$, $Z_2$, $Z_3$ and $Z_4$ are mutually independently —H, —OH, —COOH;

—OCOR, —COOR, —CR'COR or —CONR'R, and R and R' are mutually independently a hydrocarbon containing 1–22 carbon atoms which may be straight chained or branched, saturated or unsaturated, aliphatic or aromatic, provided however that the compounds according to formulas II and VII contain at least one group —COOH.

The compounds according to formulas I–VII preferably contain at least 8 carbon atoms.

In the above formula, R and R' particularly advantageously mean a hydrocarbon group containing 12–22 carbon atoms, such as a hydrocarbon group derived from oleic acid or tallow fat.

The collectors according to formulas I–VII function both with magmatic and sedimental phosphate ore.

The collectors I–VII according to the invention are more efficient than the ones disclosed by the patent specifications SU No. 1 113 174, U.S. Pat. No. 4,158,623 and FI 64 755. By using the above collectors according to the invention, a good recovery and concentration are achieved even in very fine grain classes without slime separation and even without cleaner flotations, as it appears from the examples below.

The sulphur compounds of formulas I–VII are known or may be prepared by processes known per se, cf. e.g. CA-101:73193d.

The compounds of formula I, in which Y is sulphur, can be oxidized in a known manner with e.g. hydrogen peroxide into corresponding sulphinyl compounds (Y=—SO—), which can be further oxidized e.g. with hydrogen peroxide into a corresponding sulphonyle compound (Y=—OSO—).

When the compound according to the above formula I or a mixture of them is being used in the flotation, the selectivity, the purity and the recovery as well as the quality of the froth are improved. In the flotation it is possible to use ordinary regulating agents known in the art, such as depressing agents, emulsifiers, dispersing agents, and frothers. During the flotation process ordinary physical conditions, like the temperature and the pH of the slurry, are adjusted in a known manner. Adjustment of the pH and other auxiliary chemicals are not necessarily required in the process according to the invention, and good results have proved to be achieved by one flotation without pH adjustment and auxiliary chemicals.

The invention is illustrated by the following examples.

EXAMPLE 1

A phosphate carbonate ore, which contained 9.4% of fluorapatite, 15.0% of carbonates and the balance being silicate minerals, was crushed to a particle size of below 3 mm. Of the homogenized ore a batch of 1 kg was ground with 0.7 l of water to a fineness of 35.8%–74 um. The ground material was slurried into 3 l of water and a compound of the following structure

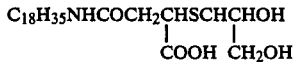

was added to the slurry in an amount of 200 g/t, and the slurry was conditioned for 10 minutes. the pH Of the slurry was not adjusted (pH 9.9–8.2). Subsequently, a rougher flotation was carried out in a 3 liter cell and the obtained rougher concentrate was subjected to three cleaner flotations a 1.5 liter cell, whereby the following results were obtained:

| | % $P_2O_5$ | Recovery % |
|---|---|---|
| Ore | 3,9 | |
| Apatite concentrate | 33,0 | 89,0 |

By using the procedure described in Example 1 but by varying the chemicals the following results were obtained.

| Example N:o | Collector | Batching g/t | pH | Apatite concentrate % $P_2O_5$ | Recovery, % |
|---|---|---|---|---|---|
| 1. | $C_{18}H_{35}NHCOCH_2CHSCH_2CHCH_2OH$ (COOH, OH) | 200 | Natural | 33,0 | 89,0 |
| 2. | $C_{14-18}H_{27-37}OCOCH_2CHSCH_2COOCH_2CHCH_2OH$ (COOH, OH) | 200 | Natural | 31,5 | 89,6 |

-continued

| Example N:o | Collector | Batching g/t | pH | Apatite concentrate % $P_2O_5$ | Recovery, % |
|---|---|---|---|---|---|
| 3. | $C_{18}H_{35}COOCH_2CH(SCH_2COOH)COOH$ | 200 | Natural | 26,0 | 90,4 |
| 4. | $C_{18}H_{35}OCOCH_2CH(COOH)SCH_2COOH$ | 200 | Natural | 25,0 | 92,3 |
| 5. | $C_{13-17}H_{27-35}CONHCH_2CH_2OCOCH_2CH(COOH)SCH_2COOH$ | 200 | Natural | 26,2 | 85,3 |
| 6. | $C_{18}H_{35}NHCOCH_2CH(COO-C_2H_5)SCH_2CH_2COOH$ | 200 | Natural | 22,7 | 85,5 |
| 7. | $C_{14-18}H_{27-37}N(COCH_2)COCHSCH_2CH_2COOH$ | 200 | Natural | 30,5 | 89,5 |
| 8. | $C_{14-18}H_{27-37}N(COCH_2)COCHSCH(CH_3)COOH$ | 200 | Natural | 32,6 | 83,3 |
| 9. | $C_{14-18}H_{27-37}N(COCH_2)COCHSCH_2COOH$ | 200 | Natural | 36,4 | 62,2 |
| 10. | $C_9H_{19}-C_6H_4-(OCH_2CH_2)_2OCOCH_2CH(COOH)SCH_2COOH$ | 200 | Natural | 15,0 | 91,6 |
| 11. | $C_{18}H_{35}OCOCH_2CH(COOH)SCH(CH_3)COOH$ | 200 | Natural | 23,0 | 94,7 |
| 12. | $C_{18}H_{35}NHCOCH_2CH(COOH)CH_2SCH_2CH_2COOH$ | 200 | Natural | 28,6 | 80,6 |
| 13. | $C_{14-18}H_{27-37}NHCOCH_2CH(COOH)SCH_2CH_2COOH$ | 200 | Natural | 22,7 | 85,5 |
| 14. | $C_{19}H_{35}NHCOCH_2CH(COOH)SCH(CH_3)COOH$ | 200 | Natural | 21,7 | 92,9 |
| 15. | $C_{18}H_{35}NHCOCH_2,CH(COOH)SCH_2CH_2OH$ | 200 | Natural | 27,3 | 58,5 |
| 16. | $C_{18}H_{35}OCOCH_2CH(SH)COOH$ | 200 | Natural | 34,2 | 73,2 |
| 17 | $C_{17}H_{33}COSCH_2COOH$ | 200 | Natural | 17,7 | 84,4 |
| 18. | $C_{18}H_{35}NHCOCH_2CH(COOH)SCH_2CH_2SO_3Na$ | 200 | Natural | 24,1 | 35,9 |
| 19. | $C_{18}H_{35}NHCOCH_2CH(COOH)SCH_2COOH$ | 200 | Natural | 15,7 | 76,7 |
| 20. | $C_{12}H_{25}NHCOCH_2CH(COOH)-S(=O)-C_{12}H_{25}$ | 200 | Natural | 13,9 | 61,3 |
| 21. | $C_{12}H_{25}OCOCH_2CH(COOH)SCH_2CH_2COOH$ | 200 | Natural | 30,5 | 89,2 |
| Cobtrol | Tall oil | 200 | 9 | 7,4 | 86,6 |
| Control* | $C_{16-18}H_{31-37}NHCOCH_2CH_2COOH$ | 200 | Natural | 14,0 | 6,1 |
| Control*** | $C_8H_{17}OCOCH_2CH(SO_3Na)COOC_8H_{17}$ | 200 | Natural | 7,2 | 45,2 |

*FI 64755
**SU 1 113 175
***U.S. Pat. No. 4,158,623

EXAMPLE 22

A phosphate carbonate ore, which contained 8.4% of fluorapatite, 15.0% of carbonates and the balance being silicate minerals was crushed to a particle size below 3 mm. Of the homogenized ore a batch of 1 kg was ground together with 0.7 l of water to a fineness of 35.8%-74 um. The ground material was slurried into 3 l of water and to the slurry was added as a collector the compound (I) 200 g/t and as an emulsifier the compound (II) 20 g/t $$C_{12}H_{25}OCOCH_2\underset{\underset{C_{12}H_{25}OCO}{|}}{C}HS\underset{\underset{COOH}{|}}{C}HCH_2OCOC_{12}H_{25} \quad (I)$$

$$C_9H_{19}-C_6H_4-(OCH_2CH_2)OH \quad (II)$$

and the slurry was conditioned for 10 minutes. The pH of the slurry was not adjusted (pH 9.8-8.3). Subsequently, a rougher flotation was carried out in a 3 liter cell and the obtained rougher concentrate was subjected to three cleaner flotations in a 1.5 liter cell, whereby the following results were obtained:

| | % $P_2O_5$ | Recovery % |
|---|---|---|
| Ore | 3.5 | |
| Apatite concentrate | 27.7 | 90.3 |

By using the procedure described in Example 22 but by varying the chemicals used and/or their amounts the following results were obtained.

| Example N:o | Collector | Batching g/t Collector | Batching g/t Emulsifier | pH | Apatite concentrate % $P_2O_5$ | Apatite concentrate Recovery, % |
|---|---|---|---|---|---|---|
| 22. | $C_{12}H_{25}OCOCH_2\underset{\underset{C_{12}H_{25}OCO}{\mid}}{C}HS\underset{\underset{COOH}{\mid}}{C}HCH_2OCOC_{12}H_{25}$ | 200 | 20 | Natural | 27,7 | 90,3 |
| 23. | $C_{18}H_{35}OCOCH_2\underset{\underset{COOH}{\mid}}{C}HSC_{12}H_{25}$ | 200 | 20 | Natural | 29,4 | 91,0 |
| 24. | $C_{16}H_{33}NHCOCH_2\underset{\underset{COOH}{\mid}}{C}HSC_{12}H_{25}$ | 200 | 20 | Natural | 34,4 | 70,6 |
| 25. | $C_{12}H_{25}NHCOCH_2\underset{\underset{COOH}{\mid}}{C}HSC_{12}H_{25}$ | 200 | 20 | Natural | 40,2 | 50,9 |
| 26. | $CH_3\underset{\underset{COOH}{\mid}}{C}HCH_2SC_{12}H_{25}$ | 200 | 20 | Natural | 23,3 | 71,7 |
| Control | $CH_3\underset{\underset{CH_2COOH}{\mid}}{C}HNHC_{12}H_{25}$ | 200 | 20 | Natural | 15,5 | 10,6 |
| 27 | $C_{18}H_{37}NHCO\underset{\underset{COCH_3}{\mid}}{C}HSCH_2COOH$ | 200 | 50 | Natural | 24,2 | 56,9 |
| 28. | $C_{12}H_{25}SCOCH_2\underset{\underset{COOH}{\mid}}{C}HSC_{12}H_{25}$ | 200 | 20 | Natural | 30,3 | 66,5 |
| 29. | $(C_{18}H_{35}OCOCH_2\underset{\underset{COOH}{\mid}}{C}H)_2-S$ | 200 | 20 | Natural | 25,8 | 82,3 |

EXAMPLE 30

A phosphate carbonate ore, which contained 7.0% of fluorapatite, 20.4% of carbonates and the balance being silicate minerals, was crushed to a particle size below 3 mm. Of the homogenized ore a 1 kg batch was ground together with 0.7 l of water to a fineness of 40.0%-74 um. The ground material was slurried into 3 l of water and a compound of the following structure $$C_{12}H_{25}OCOCH_2\underset{\underset{COOH}{\mid}}{C}HSC_{12}H_{25}$$

was added to the slurry in an amount of 200 g/t and the slurry was conditioned for 10 minutes. The pH of the slurry was not adjusted (pH 9.8-8.4). Subsequently a rougher flotation was carried out in a 3 l cell, whereby the following results were obtained

| | % $P_2O_5$ | Recovery % |
|---|---|---|
| Ore | 2,9 | |
| Apatite concentrate | 19,4 | 91,1 |

By using the procedure described in Example 30 but by varying the chemicals the following results were obtained.

| Example N:o | Collector | Batching g/t | pH | Apatite concentrate % $P_2O_5$ | Recovery, % |
|---|---|---|---|---|---|
| 30. | $C_{12}H_{25}OCOCH_2CH(COOH)SC_{12}H_{25}$ | 200 | Natural | 19,4 | 91,1 |
| 31. | $C_{12}H_{25}NHCOCH_2CH(COOH)SC_{12}H_{25}$ | 200 | Natural | 24,8 | 92,9 |
| 32. | $C_{12}H_{25}SCOCH_2CH(COOH)SC_{12}H_{25}$ | 200 | Natural | 24,4 | 87,7 |
| | $C_{12}H_{25}NHCOCH_2CH(COOH)-C_{12}H_{25}$ | 200 | Natural | 8,5 | 74,7 |
| 33. | $C_{18}H_{35}NHCOCH_2CH(COOH)SC_6H_5$ | 200 | Natural | 14,1 | 60,6 |
| 34. | $C_{18}H_{35}OCOCH_2CH(COOC_{12}H_{25})SCH(CH_3)COOH$ | 200 | Natural | 18,1 | 90,3 |

We claim:

1. A process for separating phosphate minerals from a phosphate ore by froth flotation of the phosphate minerals in the presence of an amount of a collector sufficient to yield a phosphate minerals rich froth fraction, said process comprising (a) conditioning a slurry of non-sulfidized phosphate ore with said collector, said collector being a compound having the general formula $$X_1-(CH_2)_p-S-(CH_2)_m-X_2 \qquad (I)$$

or its salt, in which formula l and m are mutually independently 0 or 1, $X_1$ and $X_2$ are mutually independently —R or —CR(R'$Z_1$)$Z_2$, $Z_1$ and $Z_2$ are mutually independently —H, —OR, —COOR, —OCOR, —NR' COR, CONR'R, —COSR, —CSOR, —COR or —$SO_3H$ or $Z_1$ and $Z_2$ form together with the carbon atoms to which they are bound the group

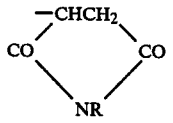

R and R' are mutually independently H or a hydrocarbon containing 1–30 carbon atoms, which can be straight chained or branched, saturated or unsaturated, aliphatic or aromatic, or a hydrocarbon moiety containing 1–30 carbon atoms which contains one or several groups among —O—, —NH—, —OCO—, —COO—, —NR'CO—, —CONR'—, —CO—, provided however, that the compound according to formula I contains at least one group among —COOH, —$SO_3H$,

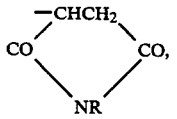

(b) subjecting said conditioned ore to a froth flotation process to yield a phosphate mineral rich froth fraction.

2. A process according to claim 1, wherein said collector comprises the following general formula $$Z_2-CH(Z_1)-(CH_2)_p-S-(CH_2)_m-CH(Z_3)-Z_4 \qquad II$$

or its salt, in which formula k, p, m, and n are mutually independently 0 or 1, $Z_1$, $Z_2$, $Z_3$ and $Z_4$ are mutually independently —H, —OH, —COOH, OCOR, —COOR, —NR'COR, —CONR'R, —COSR, —CSOR, —COR or —$SO_3H$ and R and R' are mutually independently a hydrocarbon containing 1–30 carbon atoms, which can be straight chained or branched, saturated or unsaturated, aliphatic or aromatic, or a hydrocarbon moiety containing 1–30 carbon atoms which contains one or several groups among —O—, —NH—, —OCO—, —COO— —NR'CO—, —CONR'—, —CO—, provided however, that the compound according to formula II contains at least one group among —COOH, —$SO_3H$,

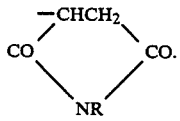

3. A process according to claim 1 or 2, wherein said collector comprises the following general formula $$Z_2-CH(Z_1)(CH_2)_p-S-(CH_2)_m-CH(CH_2-Z_4)-Z_3 \qquad III$$

or its salt, in which formula p and m are mutually independently 0 or 1, $Z_1$, $Z_2$, $Z_3$ and $Z_4$ are mutually independently —H, —OH, —COOH, —OCOR, —COOR, —NR'COR or CONR'R, and R and R' are mutually independently a hydrocarbon containing 1-22 carbon atoms, which can be straight chained or branched, saturated or unsaturated, aliphatic or aromatic, provided however that the compound according to formula III contains at least one group —COOH.

4. A process according to claim 1, wherein the collector comprises the following general formula

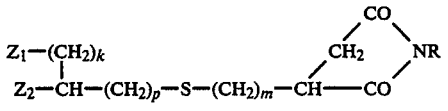

or its salt, in which formula k, l and m are mutually independently 0 or 1, $Z_1$ and $Z_2$ are mutually independently —H, —OH, —COOH, —OCOR, —COOR, —NR'COR, —CONR'R, —COSR, CSOR, —COR or —$SO_3H$ and R and R' are mutually independently a hydrocarbon containing 1-30 carbon atoms, which can be straight chained or branched, saturated or unsaturated, aliphatic or aromatic, or a hydrocarbon moiety containing 1-30 carbon atoms which contains one or several groups among —O—, —NH—, —OCO—, —COO—, —NR'CO—, —CONR'—, —CO—.

5. A process according to claim 1 or 4, wherein said collector comprises the following general formula

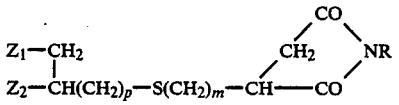

V or its salt, in which formula p and m are mutually independently 0 or 1, $Z_1$ and $Z_2$ are mutually independently —H, —OH, —COOH, —OCOR, —COOR, NR'COR or —CONR'R and R and R' are mutually independently a hydrocarbon containing 1-22 carbon atoms, which may be straight chained or branched, saturated or unsaturated, aliphatic or aromatic.

6. A method according to claim 1, wherein said collector comprises the following general formula

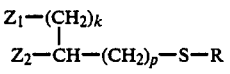

VI or its salt, in which formula k and p are mutually independently 0 or 1, $Z_1$ and $Z_2$ are mutually independently —H, —OH, —COOH, —OCOR, —COOR, —NR'COR, —CONR'R, —COSR, —CSOR, —COR or —$SO_3H$, and R and R' are mutually independently a hydrocarbon containing 1-30 carbon atoms, which may be straight chained or branched, saturated or unsaturated, aliphatic or aromatic, or a hydrocarbon moiety containing 1-30 carbon atoms which contains one or several groups among —O—, —NH—, —OCO—, —COO—, —NR'CO—, —CONR'—, —CO—;

provided however, that the compound according to formula VI contains at least one group among —COOH, —$SO_3H$,

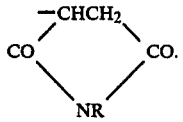

7. A method according to claim 1 or 6, wherein said collector comprises the following general formula

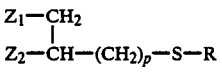

VII or its salt, in which formula p is 0 or 1, $Z_1$ and $Z_2$ are mutually independently —H, —OH, —COOH, —OCOR, —COOR, NR'COR or —CONR'R and R and R' are mutually independently a hydrocarbon containing 1-22 carbon atoms, which may be straight chained or branched, saturated or unsaturated, aliphatic or aromatic; provided however, that the compound according to formula VII contains at least one group —COOH.

8. The process of claim 1 wherein said phosphate ore comprises a phosphate-carbonate ore.

* * * * *